US006194836B1

(12) United States Patent
Pacquet et al.

(10) Patent No.: US 6,194,836 B1
(45) Date of Patent: Feb. 27, 2001

(54) MAGNETIC SYSTEM, PARTICULARLY FOR ECR SOURCES, FOR PRODUCING CLOSED SURFACES OF EQUIMODULE B OF FORM DIMENSIONS

(75) Inventors: Jean-Yves Pacquet, Hérouville St Clair; Renan Leroy, Authie, both of (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/319,561

(22) PCT Filed: Dec. 17, 1997

(86) PCT No.: PCT/FR97/02328

§ 371 Date: Jul. 27, 1999

§ 102(e) Date: Jul. 27, 1999

(87) PCT Pub. No.: WO98/27572

PCT Pub. Date: Jun. 25, 1998

(30) Foreign Application Priority Data

Dec. 18, 1996 (FR) ..... 96 15572

(51) Int. Cl.[7] ..... H01J 7/24; H05B 31/26

(52) U.S. Cl. ..... 315/111.71; 118/723 MR; 118/723 MA

(58) Field of Search ..... 315/111.71, 111.21, 315/111.41; 118/723 MR, 723 MA

(56) References Cited

U.S. PATENT DOCUMENTS 4,417,178 11/1983 Geller et al. ..... 315/111.81
4,580,120 4/1986 Jacquot ..... 335/301
4,641,060 2/1987 Dandl ..... 315/111.71
5,620,522 * 4/1997 Ichimura et al. ..... 118/723 MR

FOREIGN PATENT DOCUMENTS 0142 414 5/1985 (EP) .
0 483 004 4/1992 (EP) .

OTHER PUBLICATIONS

Zschornack, G., et al., "A 14.6–GHz ECR ion source for atomic physics and materials research with highly charged slow ions," Review of Scientific Instruments, vol. 63, No. 5, pp. 3078–3083, (May 1992).

Jacquot, B., "Source D'lons Lourds Caprice 10 Ghz $2\omega_{ce}$," Nuclear Instuments and Methods in Physics Research, Section—A: Accelerators, Spectrometers, Dectectors and Associated Equipment, vol. a269, No. 1, pp. 1–6, (Jun. 1988).

Sortais, P., et al. "Developments of Compact Permanent Magnet ECRIS," International Workshop on ECR Ion Sources, pp. 44–52, (1992).

* cited by examiner

*Primary Examiner*—Michael B Shingleton
(74) *Attorney, Agent, or Firm*—Burns Doane Swecker & Mathis L.L.P.

(57) ABSTRACT

The invention relates to a device for generating a magnetic field $\vec{B}$, comprising a multi-pole structure ($M_1$, $M_2$, $M_3$) in which the elements have polarities such that the vector sum of the fields created at each point by each of these elements is sufficient to define at least one closed line of minima B inside a surface with constant modulus (70) closed in the space. Application for an ECR source.

13 Claims, 8 Drawing Sheets

MAGNETIC SYSTEM, PARTICULARLY FOR ECR SOURCES, FOR PRODUCING CLOSED SURFACES OF EQUIMODULE B OF FORM DIMENSIONS

DESCRIPTION

Technical Field

The invention relates to the field of magnetic devices to create a magnetic field, particularly for an application for an ECR (electronic cyclotronic resonance) source. This type of source is used to produce ions.

Document FR-2 475 798 describes a process and a device for production of highly charged ions. The device comprises a hyperfrequency cavity excited by at least one high frequency electromagnetic field. This field is associated with a magnetic field, the amplitude of which is chosen such that the electronic cyclotronic frequency associated with the said magnetic field is equal to the frequency of the electromagnetic field set up in the cavity. The condition is:

$$B=f.2\pi m/e \quad (1)$$

where m is the mass of the electron, e is the electron charge and f is the frequency of the electromagnetic field.

In this device, the magnetic field is created by superposing:

- a multi-pole radial magnetic field with a minimum amplitude in the central part of the cavity,
- and an axial magnetic field with a symmetry of revolution, with a gradient along the said axis, the total resultant magnetic field being adjusted such that there is at least one completely closed magnetic layer in the cavity, without any contact with the walls of the cavity. The electronic cyclotronic resonance condition is satisfied on this layer, so that the gas passing through it will be ionized.

The device described in this document will now be summarized with reference to FIG. 1. Two sources (not shown) are used to send ionizable gas through pipes 2, 4 that lead into a confinement chamber 6 in which a vacuum pump creates a high vacuum. An electromagnetic field is introduced through wave guides 8, 10.

Pairs of axial coils 14, 16 are used to produce the axial magnetic field. The multi-pole radial magnetic field with zero amplitude at the center of the cavity is created using bars 18 placed parallel to each other. The resultant magnetic field superposed on the HF electromagnetic field enables electronic cyclotronic resonance.

Document EP-138 642 also describes a magnetic confinement structure (FIG. 2) in which the solenoids 20 supply an axial field Ba that is superposed on a radial field Br generated by permanent magnets 22 mounted on the inside wall of a cylindrical casing 24. The assembly of the two solenoids is shielded by a ferromagnetic casing 26. This type of device magnetizes a useful volume 28.

The device illustrated in FIG. 3 diagrammatically shows a target-source assembly called "Nanomafira". This assembly is described in the paper by P. Sortais et al. entitled "Developments of compact permanent magnets ECRIS", $12^{th}$ International Workshop on ECR Ion Sources, Apr. 25–27, 1995, Riken, Japan. A set of magnets 32, 34, 36 is placed around a plasma confinement zone 38 in order to define an axial field. A multi-pole structure 37 defines a radial field that is superposed on the axial field.

The fact that a certain volume called the confinement volume is magnetized is common to all these devices.

Experience shows that the use of high volume plasma chambers can result in increased performances. Making a high volume plasma chamber involves magnetizing a large volume, and therefore involves the use of significant magnetic resources and the use of a large electric power, or the use of a large number of magnets.

Furthermore, the UHF frequency that has to be used to produce monocharged ions, or ions with low charged states, is low. Consequently, the magnetic field to be used is also low (relation (1)). However, the UHF frequency must be high to produce multicharged ions. This means that a magnetic field with a high modulus has to be used in the confinement volume.

For example, all that can be produced using a Nanomafira source (described above) with a 26 mm diameter and 90 mm long confined volume, is 55 $\mu$A of $Ar^{8+}$ ions and 3 $\mu$A of $Ar^{11+}$ ions.

Another disadvantage of conventional ECR sources is that they have a clearly defined magnetic structure, and consequently a very narrow frequency usage range around a given central value. Thus, these sources can operate around 2.5 GHz, or 6.5 GHz or 10 GHz, or 14 GHz, or 18 GHz. But they are not compatible with use in wide band.

Another disadvantage of known ECR sources is that they cannot be installed at the center of a cyclotron. FIG. 4 diagrammatically shows a sectional view of two plates 48, 50 in a cyclotron, between which a magnetic field B is setup. Reference 52 denotes an ECR ion source and reference 56 diagrammatically shows an injection line of ions produced by source 52, and means of adapting the beam in order to inject it at the cyclotron input. The particle beam 58 inside the cyclotron is deflected by electrostatic means 54. The beam can then be accelerated in the hyperfrequency cavities. A conventional ECR source 52 cannot be built into the inside the cyclotron, due to its environment and its radial multi-pole magnetic components.

Another disadvantage of conventional ECR sources is the need to extract the ion beam along the axis of symmetry of the source, and only along this axis.

A device with lateral extraction has to be made if it is required to couple an ECR source in a cyclotron.

Furthermore, a source with lateral extraction may have an advantage for many applications, not only for applications to a cyclotron. In particular, an ion source with lateral extraction, either partial or even over 360°, would be very useful for the ion implantation technique. At the present time sources used for this technique have an extraction hole with a diameter of about 10 mm, which can only give a single beam. Furthermore, the principle of extraction through a hole on the axis and the radial components of the field created by the multi-pole system, cause non-uniformities in the beam extracted from the source.

DISCLOSURE OF THE INVENTION

The purpose of the invention is a device for generating a magnetic field B comprising a multi-pole structure for which the elements have polarities such that the vector sum of the fields created by each of these elements at each point in space delimited by the said elements is sufficient to define at least one continuous and closed line of minima inside a surface with constant modulus closed in the said space.

In the invention, the closed surface with modulus $B_f$ surrounds an internal volume in which in particular the magnetic field may have a very low minimum B, unlike what takes place in known ECR sources.

With this type of source, the maximum operating frequency is defined by the closed surface with constant modulus for which the field is a maximum and equal to $|B_f|$, obtained inside the multi-pole structure. Therefore, the same source can operate at low frequency $f_0$ without modification if a closed line of minima $|B_0|$ is compatible with this frequency, in other words satisfies the relation $B_0=f_0 2\pi m/e$. Therefore, the device according to the invention is compatible with operation in wide band.

Furthermore, this type of device can easily be modulated and its volume may be adjusted; the increase in volume does not require the use of much larger magnetic means. In the device according to the invention, there is no need to create a large magnetic field far from elements in the multi-pole structure; the magnetic field can decrease quickly when moving away from these elements.

Therefore the invention relates particularly to a device capable of generating a magnetic field in a cavity in which an HF electromagnetic wave is injected using appropriate means, the modulus of the magnetic field being such that the electronic cyclotronic frequency associated with this magnetic field is equal to the frequency of the electromagnetic field, on a closed magnetic layer, in order to cause ionization of the gas passing through it and to create a plasma, particularly to produce ECR type ion sources.

In order to increase the volume of the plasma chamber for an ion source without excessive magnetic means and/or to produce multicharged ions, and/or to operate within a wide frequency usage range, and/or to obtain an ion source with lateral extraction (coupling between ECR source and cyclotron, to obtain ion sources in a high density layer, for example for ion implantation), the invention provides a multi-pole structure formed from elements with moduli and polarities such that the resultant magnetic field at any point in space delimited by them defines at least one closed line of minima inside a surface with constant modulus closed in space.

The device according to the invention may be made either with permanent magnets, or with coils, or with a combination of the two. If the environment in which the device is used prevents the use of permanent magnets (due to the existence of a large flux of neutrons or charged particles, or use in an environment with extreme temperatures, etc.), the use of coils can facilitate embodiment of the invention.

According to one particular embodiment, the device according to the invention comprises a multi-pole assembly broken down into three subassemblies and formed of $N \geqq 3$ magnetic means:

- a set of $N_1$ magnetic means to form an axial magnetic structure,
- two sets of $N_2$ magnetic means to form radial magnetic structures.

The magnetic means with alternating polarity used to form an axial magnetic field can be in the form of rings adjacent to each other.

The magnetic means with alternating polarity used to form radial magnetic structures can be in the form of rings nested inside each other.

One or both of the radial structures may have a central opening, particularly useful to extract ions in a magnetic field without a multi-pole radial component.

At least one lateral opening can also be provided around the periphery of the device; this type of arrangement was difficult to achieve in devices according to prior art, because eliminating part of the multi-pole radial structure very much decreases the efficiency of magnetic confinement.

According to another arrangement, each assembly of $N_2$ magnetic means comprises $N_2$ magnetic means laid out coaxially around each other according to their diameter, either in the same plane or slightly offset, to form the radial structure.

Another purpose of the invention is an ECR source comprising a device to generate a magnetic field like that described above, the volume inside the multi-pole structure defining a plasma confinement chamber and means of installing a target.

Another purpose of the invention is a process for production of ions using this type of ECR source.

Another purpose of the invention is a cyclotron operating process, the ions being injected into the cyclotron using an ECR source as described above.

Advantageously, the ECR source is located inside the cyclotron.

Another purpose of the invention is a process for the transport of charged particles, using a device according to the invention comprising $N_1$ magnetic means with alternating polarity to form the axial magnetic structure in the form of rings placed adjacent to each other, two sets of $N_2$ magnetic means with alternating polarity to form the radial magnetic structures, the particles being transported from one end to the other of the set of adjacent rings.

Another purpose of the invention is a confined plasma pump comprising a device to generate a magnetic field according to the invention, lateral means to inject HF radiation, lateral means of connecting to a volume to be pumped, and extraction and neutralization means for the pumped particles.

Therefore, the device according to the invention may be applied to a cyclotron, to a plasma transfer line, to a mass or charge spectrometer (in which the ECR source according to the invention is associated with magnetic field scanning means in the extraction zone), and a confined plasma pump in which the ECR source according to the invention is associated with extraction optics and neutralization means.

BRIEF DESCRIPTION OF THE FIGURES

In any case, the characteristics and advantages of the invention will become clearer by reading the following description. This description is applicable to example embodiments given for explanatory purposes and in no way restrictive, with reference to the attached drawings in which.

DETAILED DESCRIPTION OF EMBODIMENTS OF THE INVENTION

A first example embodiment of the invention will be described with reference to FIG. 5.

In this figure, references 62-1, . . . , 62-4 denote four magnetic rings with alternating polarity that form the axial structure. References 64.1, . . . , 64-5 and 66-1, . . . , 66-4, denote magnetic rings of two lateral assemblies with alternating polarity that form the radial magnetic structures.

Reference 68 denotes an opening formed in one of the side walls.

Therefore this device comprises two assemblies $M_1$ (64-1, . . . , 64-5) and $M_2$ (and 66-1, . . . , 66-4) forming its ends, and a lateral assembly $M_3$ (62-1, . . . , 62-4). This system $M_3$ may be composed of a multi-pole structure defined by sectors (rather than by rings only) with symmetry with respect to the axis of symmetry A of the device. In the case in which one or both of the systems $M_1$ and $M_2$ consist of several poles, as shown in FIG. 5, the magnetic assembly formed of $M_1$, $M_2$ and $M_3$ is in the form of a superposition of a radial multi-pole magnetic field with an axial multi-pole field.

System $M_3$ may be composed of $N \geqq 0$ rings positioned or placed adjacent to each other longitudinally, and with a radial or axial magnetization with a polarity defined by their position in the system. These elements may have different cross-sections and therefore the dimension or diameter of this assembly along axis A may be variable. The assembly obtained with $M_1$, $M_2$ and $M_3$ then forms a single multi-pole.

The volume obtained confined by an envelope with constant moduli $|B_f|$ composed of the magnetic assembly of systems $M_1$, $M_2$ and $M_3$ is then in the form of a magnetic box "with a closed line of minima |B|".

Figure 6:
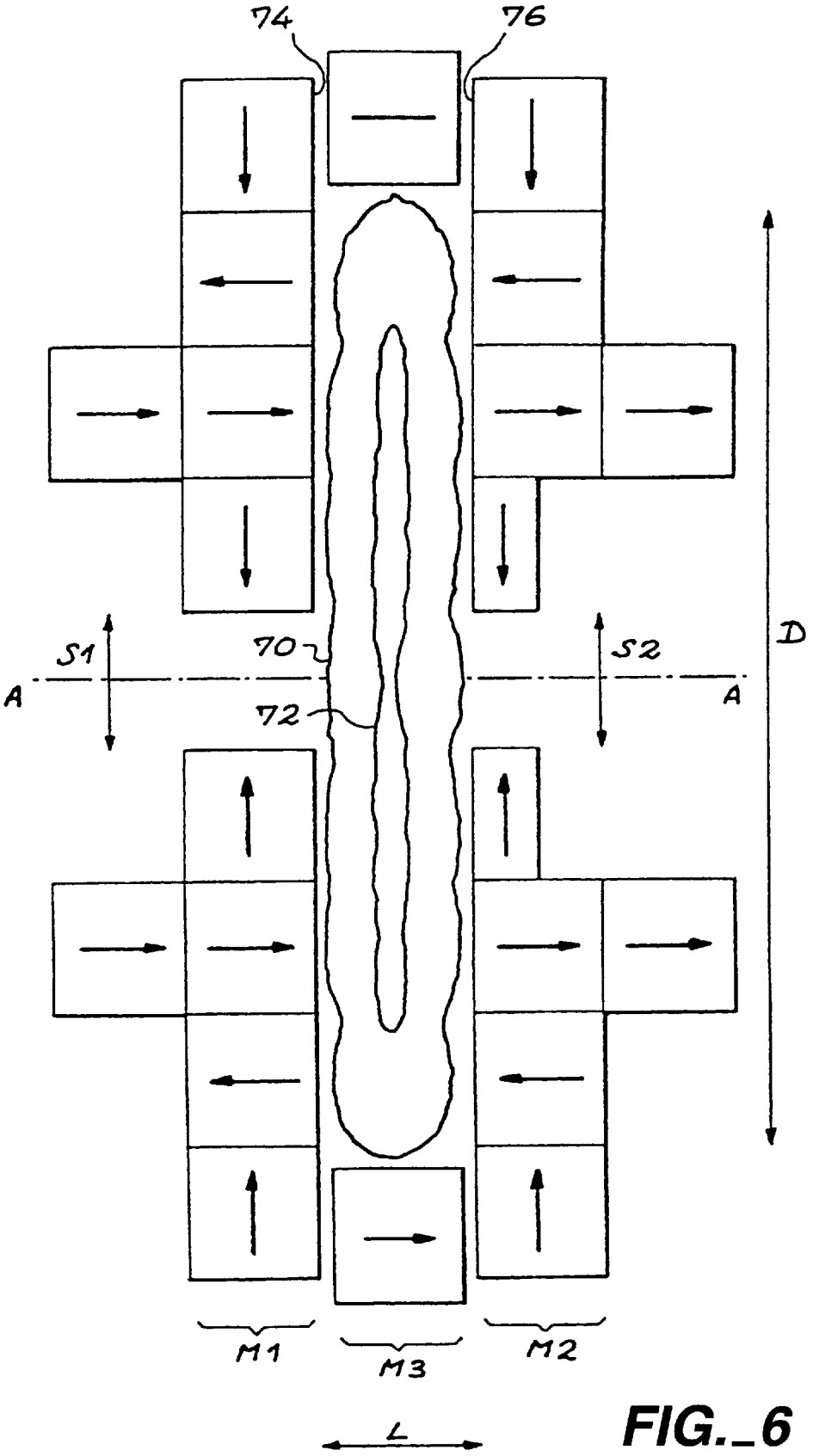
FIG. 6 is a special case illustrating an application of the invention.

FIG. 6 shows a sectional view of a magnetic device according to the invention in the special case in which the $M_3$ system consists of a single ring. The arrows show the orientation of the polarities of the different magnetic elements. In this figure, reference 70 denotes the surface with constant moduli $|B_f|$ inside which a closed surface with constant modulus $B_r$ 72 can be identified. In this figure, each lateral element $M_1$ and $M_2$ has a central opening $S_1$, and $S_2$. For application to an ECR source, these openings make it possible to approach a target carrier system, and to arrange extraction means for the ions produced. In general, the two surfaces $S_1$ and $S_2$ are available for the various systems in order to control and use a plasma; HF injection, gas injection, furnace, diagnostic means, particle injection, cooling and pumping device, etc.

In particular, if the ECR source thus made is required to ionize condensable elements (particularly metals), an evaporation source may be placed very close to the plasma at different locations along axis A, at openings $S_1$, or $S_2$ or around its periphery. In this case, the evaporation area of the evaporation source facing the plasma may be large, and have a large solid angle with the confined zone, so that a good ionization efficiency can be obtained.

Several solutions are possible for extraction.

If extraction is done along the A axis (as shown in FIG. 6), and if the magnetic confinement does not have any radial polar components (radial multi-pole structures $M_3$ are no longer necessary for confinement; for multi-pole only), the emittance of the extracted beam then has a symmetry of revolution, facilitating its transport.

If an axial multi-pole is superposed with a radial multi-pole and if dimension D (see FIG. 6) is sufficiently large, which is possible particularly with a source according to the invention, the radial magnetic components will have a negligible influence on the axially extracted beam.

Extraction may also be done around the periphery (outside "diameter") either partially at one location (single extraction) or at several locations (multi-extractions) or around its entire periphery. An opening formed in the side of the $M_3$ system does not disturb confinement of this zone if the local reduction in the field is compensated by surrounding systems. An example of lateral extraction in addition to axial extraction is described later in liaison with FIGS. 10 to 12, for the purposes of another application.

A coil that creates or modulates the extraction field offers the additional possibility of being pulsed between two values, thus adjusting the confinement time of a ion packet before its extraction.

Figure 1:
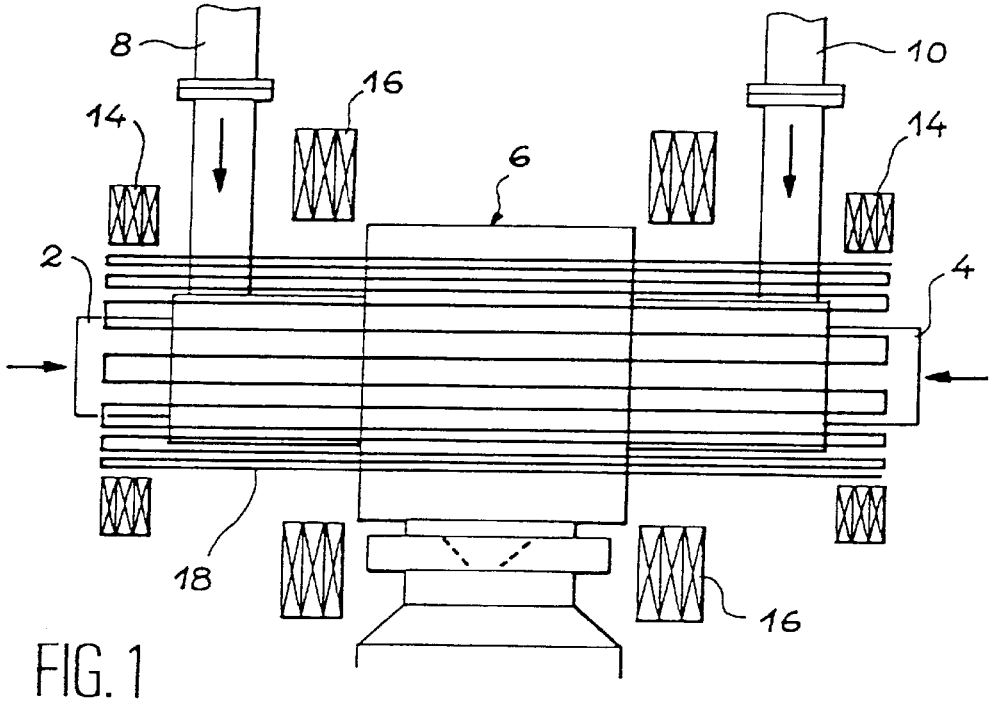
FIGS. 1 to 3 diagrammatically show ECR sources according to prior art.
Figure 2:
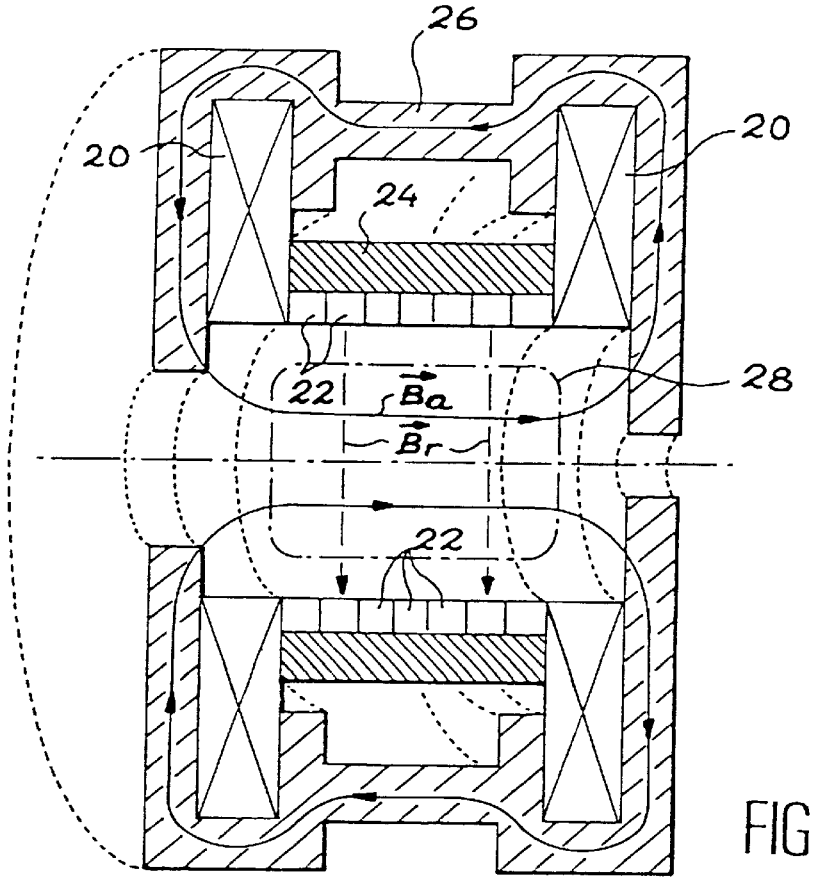
Figure 3:
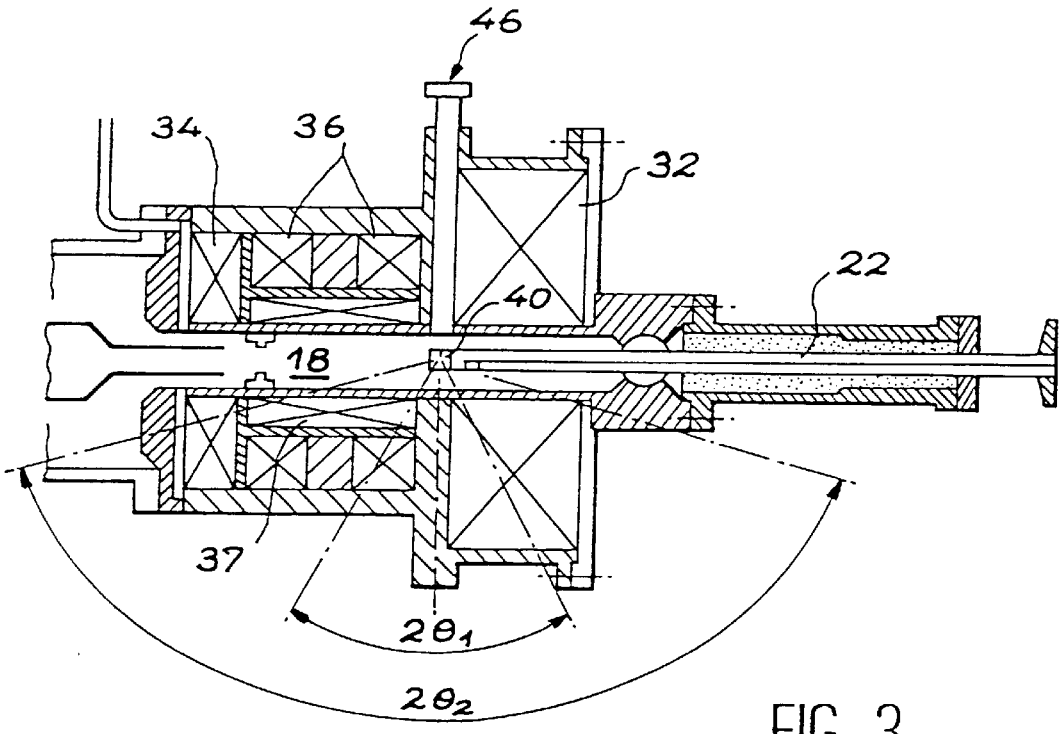
Figure 4:
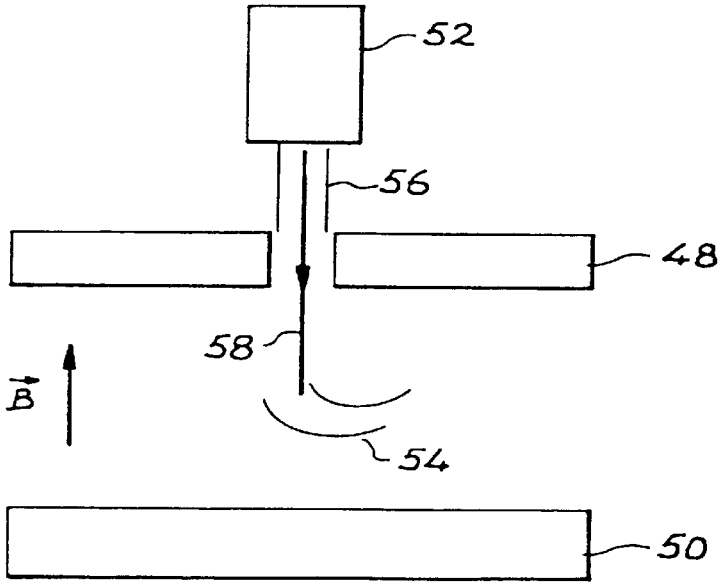
FIG. 4 diagrammatically shows an ECR source coupled to a cyclotron.
Figure 5:
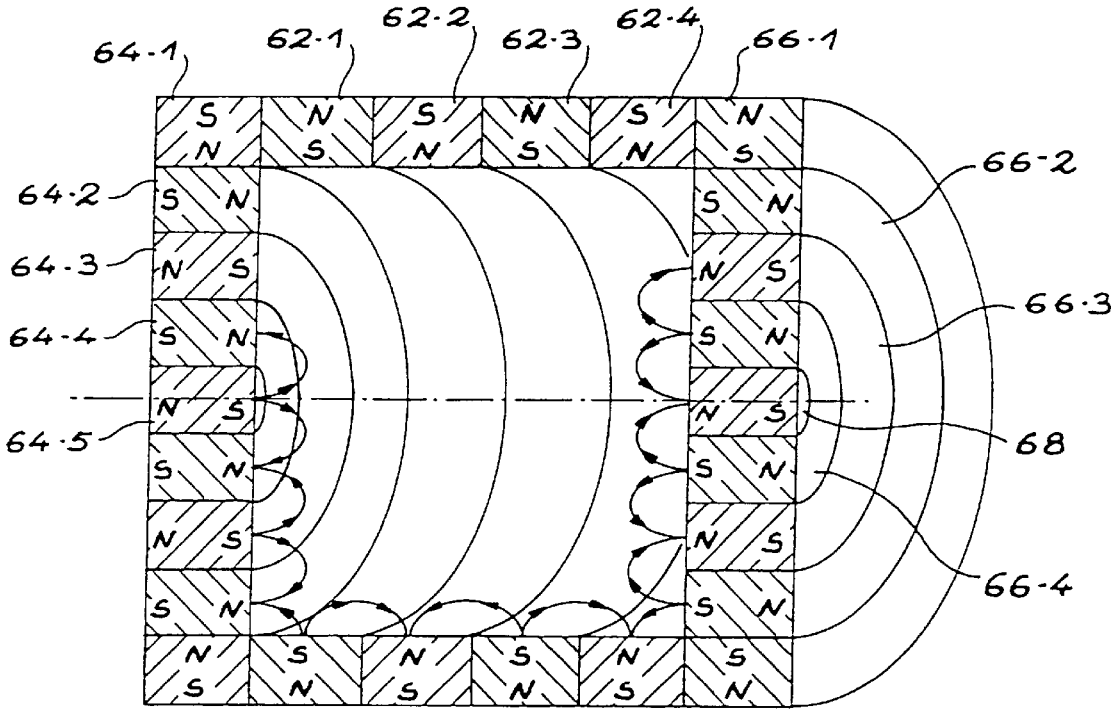
FIG. 5 shows an example embodiment of the invention.

The following comments are applicable to the device in FIGS. 5 and 6:

- dimension D of the source along a plane perpendicular to the A axis only depends on the area and the shape of each of the two assemblies $M_1$ and $M_2$ forming the ends of the source,
- dimension L along the A axis depends on the length and geometry of the $M_3$ system,
- the two assemblies $M_1$ and $M_2$ may be composed of one or several elements laid out coaxially, around each other depending on their diameter, either in the same plane or slightly offset.

Figure 10:
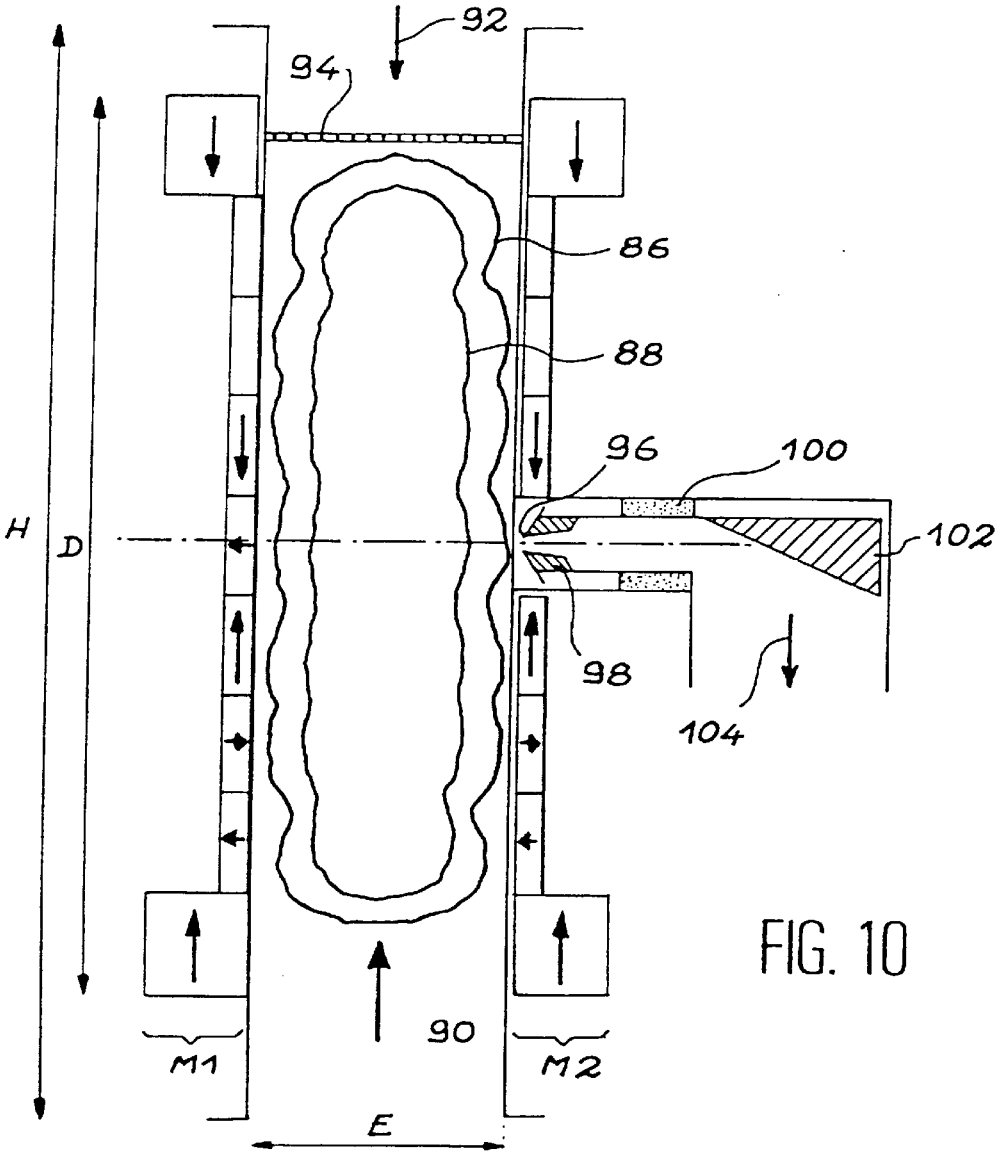
FIGS. 10 to 12 show miscellaneous views of a confined plasma pump according to the invention.

For sufficiently short lengths L, the system $M_3$ may consist of a magnetic assembly the elements of which are outside the dimension L, the end elements $M_1$ and $M_2$ possibly defining or contributing to defining this system. In FIG. 10, the field to be created by the $M_3$ system is defined by the $M_1$ and $M_2$ systems, thus freeing the entire periphery over the length E (=L). In this case, the environment along length L is completely clear, thus facilitating access to the confined zone (UHF injection, gas inlet, furnace, diagnostic means, target, injection of charged particles, ion extraction, etc.).

Figure 7:
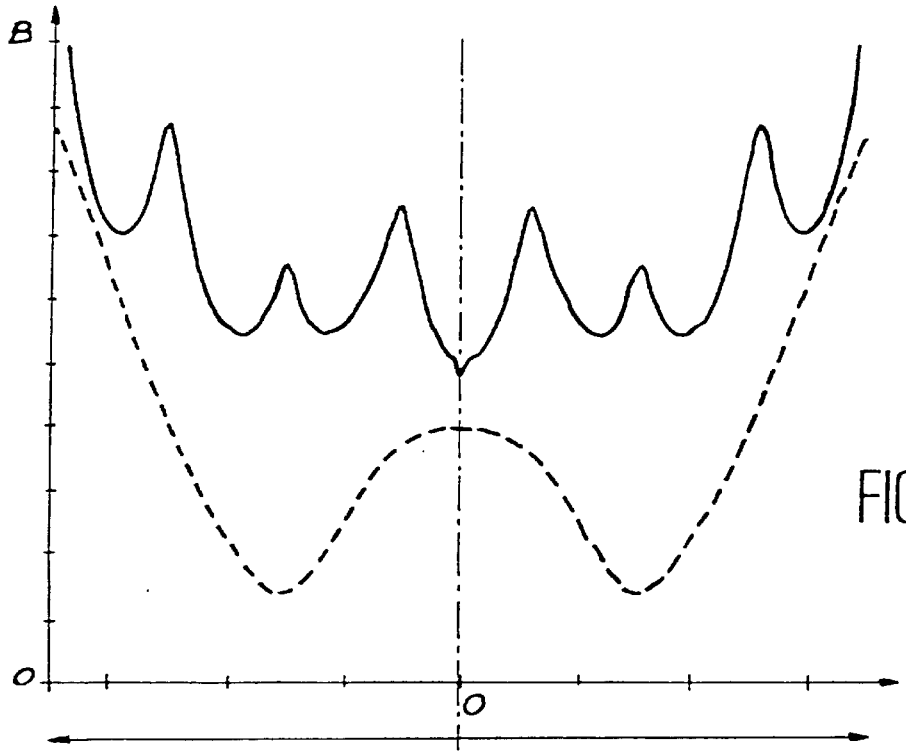
FIG. 7 shows the variation of magnetic fields in space for the device in FIG. 6.

FIG. 7 shows the magnetic field obtained using a device according to FIG. 6. The curve shown with a solid line shows the variation of the modulus |B| close to the inside surface 76 of assembly $M_2$ on each side of the A axis (see FIG. 6). The curve shown with a dashed line shows the variation of the modulus |B| half way between the surface 76 and the surface 74 (surface inside the assembly $M_1$) on each side of the A axis (see FIG. 6). FIG. 7 shows that an intense magnetic field is obtained close to the surfaces of elements $M_1$ and $M_2$ and that a configuration with two lines of minima is obtained in the center. In conventional devices, a larger field is maintained inside the surface 70.

Figure 8:
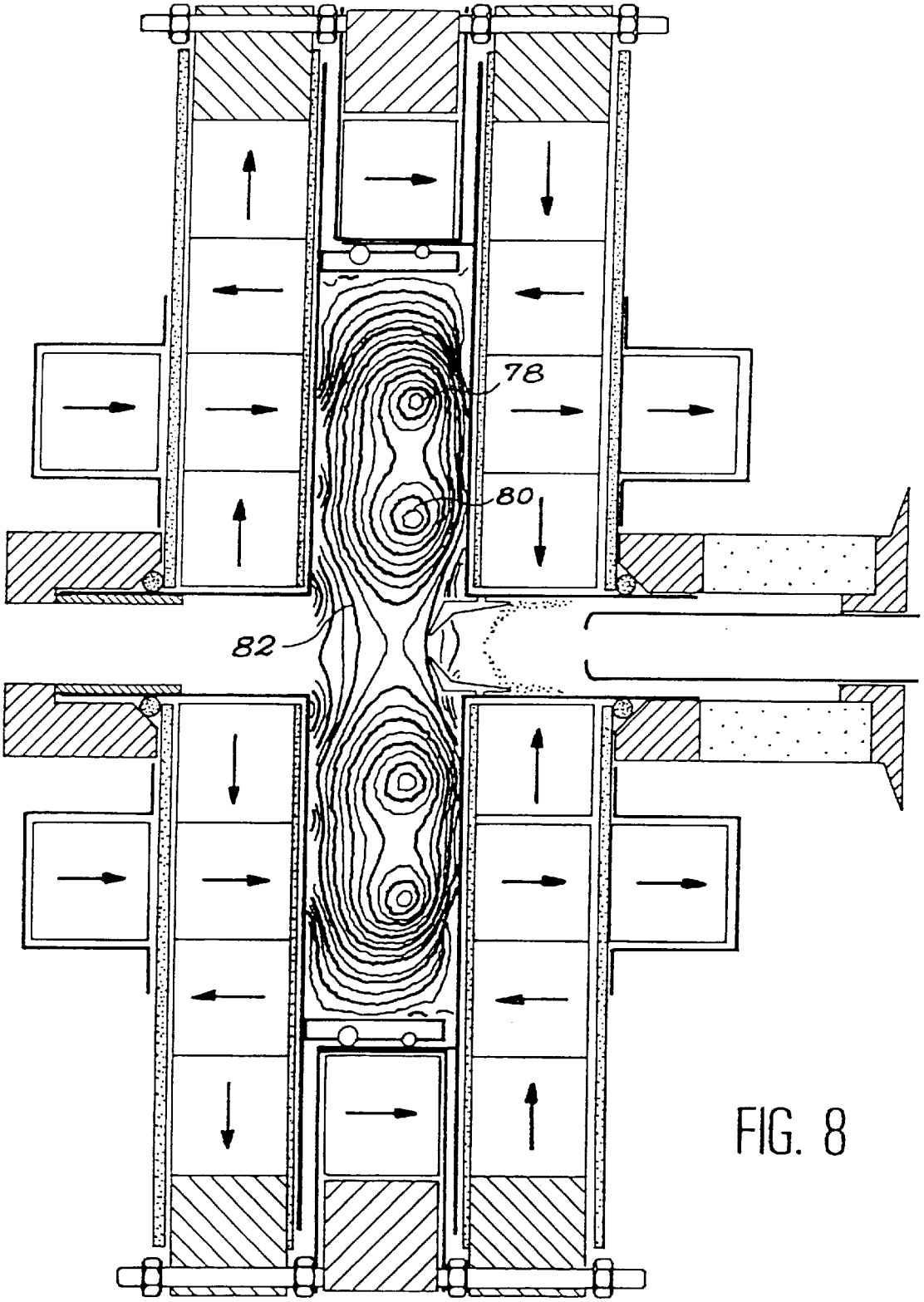
FIG. 8 shows the distribution of magnetic lines with equal modulus for the device in FIG. 6.

FIG. 8 shows the magnetic lines with constant modulus for the same magnetic structure as in FIG. 6. According to the invention, the magnetic multi-pole polarities are chosen and oriented such that the vector sum of the fields created at each point by each of these elements produces a profile with a closed line of minima |B|. Reference 82 in FIG. 8 denotes an surface with constant modulus $|B_f|$(maximum modulus of the magnetic field), whereas references 78 and 80 denote O-ring cross-sections defined by the lower values of magnetic fields. Closed lines of minima are defined on the inside of these O-rings (78 and 80). In the example shown in FIG. 8, the field at the center of mark 80 is 20 times less than the field for line 82. Actually, the maximum operating frequency for this type of source is defined by the closed surface of the modulus of the maximum field $B_f$ obtained inside the device (reference surface 82 in FIG. 8). The magnetic field is kept at this maximum value on this surface, and not in volume. Inside this surface, the magnetic field may decrease quickly as the distance from walls 74, 76 increases and when entering closer towards the inside of the confinement zone. This means that the same source may operate without modification at the frequency corresponding to $B_f$ and at low frequency, if a closed line of minima |B| is compatible with this frequency.

In general, magnets thinner than those used in conventional devices can be used in order to obtain a closed line of low minima B. Furthermore, in the case shown in FIGS. 6 and 8, the distances between the two magnetic assemblies $M_1$ and $M_2$ may be larger; it would also be possible to choose the polarities of the components of $M_1$ and $M_2$ in order to obtain a closed line of minima B between $M_1$ and $M_2$ composed of points at which the field modulus is low or even zero.

The magnetic field moduli, and the confined volume of this type of source or this type of device, can be very variable. The volume can be modified simply by changing the number of elements, for example in the case in FIGS. 6 and 8 along either of the longitudinal or radial dimensions, or along both directions. Thus in the examples in FIGS. 6 and 8, all that is necessary is to double the longitudinal dimension of the $M_3$ system, for example, to double the confined volume of the source. The increase in weight of the magnets is then only of the order of 15 to 20%. This increase in volume does not require a large increase in the magnetic means, since this field is only held at its maximum value close to the inside walls of the device, and not inside the entire volume. Thus, if thin permanent magnets are used, a closed surface with constant magnetic moduli $B_f$ is created close to the wall, compatible with the chosen HF frequency; since this magnetic field decreases quickly with distance moved away from the wall towards the closed surface(s) with constant modulus(moduli) $B_r$, and then towards the line(s) of minima B.

Consequently, the invention can be used to obtain a large confined volume which was impossible using devices according to prior art, without the need for large resources to obtain it.

The source shown in FIG. 6 can operate without magnetic means $M_3$. In this case, since the source does not have any multi-pole radial field components, it may be installed in the center of a cyclotron by modulating its field with the $M_1$ and $M_2$ systems in order to obtain the "closed line of minima B" condition. Extraction can then take place through the end of an HF cavity. Thus, a compact "cyclo-source" assembly can be built on this principle. The fact that components of the multi-pole radial field in a device according to the invention are eliminated also has an influence on the quality of the beam extracted on the axis.

Based on the same principle, and if the extraction is radial (on the periphery) this type of source which have a dipole magnetic field in the extraction zone, can be used to make an analysis of ions in integrated Q/M, therefore this means that the mass and charge of the ion can be varied, for example by varying the extraction voltage for a given physical extraction layout.

Figure 9:
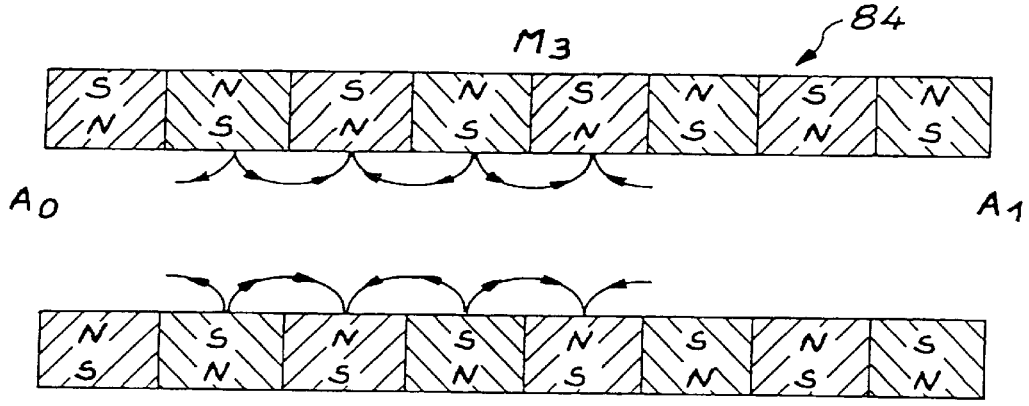
FIG. 9 shows a confined plasma particles transport line.

Another application for a device according to the invention will now be described in relation to FIG. 9. In this figure, reference 84 denotes a device to generate a magnetic field according to the invention; this device comprises a multi-pole structure (for example of adjacent rings), in order to define a closed surface with constant moduli Bf, and at least one closed line of minima B inside this surface. The multi-pole structure considered is linear in this case and is created by the $M_3$ system. The lack of the $M_1$ and $M_2$ systems is compensated by the ends of $M_3$. Due to the confined plasma, this means that condensable materials can be transferred in the form of charged particles from a location $A_0$ to a location $A_l$. For example at $A_0$ there is an HF injection and the condensable or incondensable particle production source(s). Since magnetic confinement satisfies the operating criteria for an ECR source, the particles are ionized and can therefore be extracted at point $A_1$ for any use whatsoever.

We will now describe another application of the invention; manufacture of confined plasma pump.

A plasma created by an ECR source is used to ionize the particles originating from a chamber in which a low pressure is to be obtained. The particles are extracted from this source to take them into another chamber called the neutralization chamber in which the pressure is higher.

As illustrated in FIG. 10, this pump consists of an ECR source according to the invention. As has been described above, this type of source is capable of confining ions within a volume delimited by an surface with constant modulus $B_f$. Thus the source shown in FIG. 10 comprises two assemblies $M_1$ and $M_2$ defining a multi-pole structure. $M_3$ is reconstituted by $M_1$ and $M_2$ (particularly by the end rings). The confined volume is delimited by a closed surface 86. Reference 88 denotes a closed surface with constant modulus $B_r$. The peripheral part of this source may be used to inject an HF wave (arrow 90) and for pumping (arrow 92) from a containment to which the source is connected. Reference 94 denotes a grid that surrounds the confinement zone, and which prevents the hyper-frequency wave from propagating towards the intake means.

Figure 12:
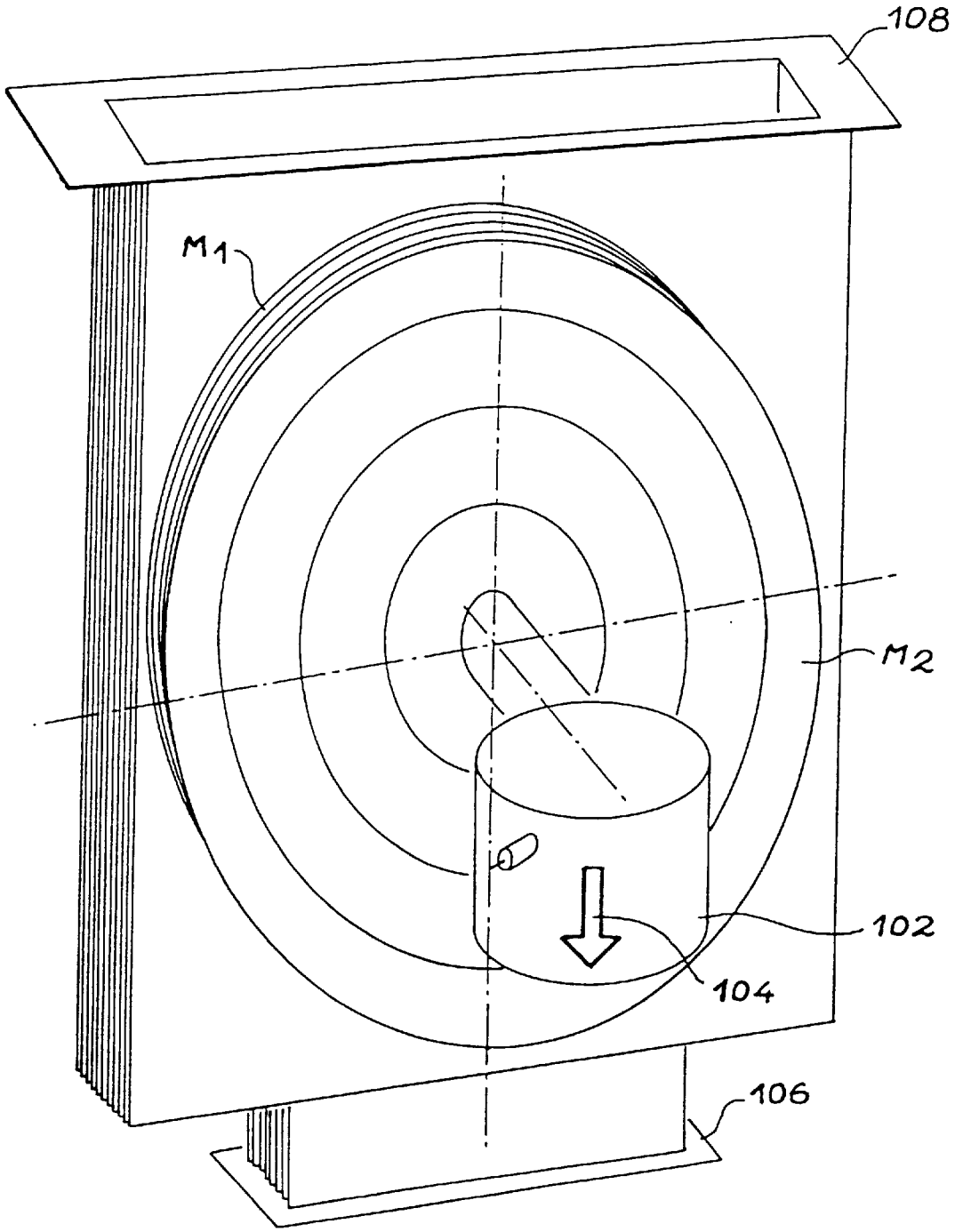

The chamber, also shown in FIG. 12, is connected through a flange 106 to HF wave injection means (which may be a low frequency wave, for example at 2.45 GHz) and through a flange 108 to the containment in which pumping is to be done.

Figure 11:
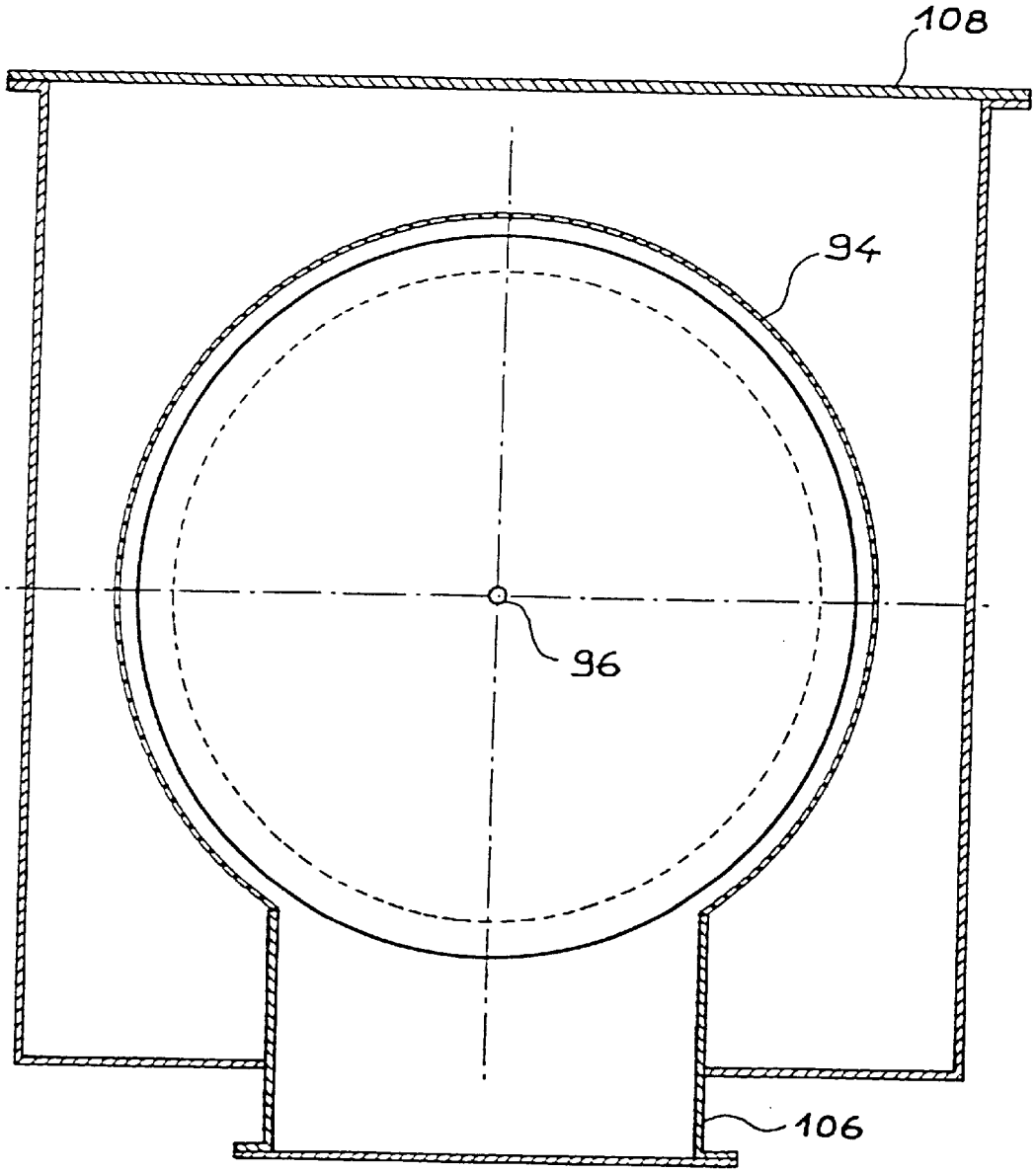

Ions are extracted from the chamber through an opening 96 (FIG. 11). The extraction system comprises electrodes 98 to which an extraction voltage is applied, an insulating ring 100, and a neutralization unit 102. The neutralization unit may be cooled, if the energy of the ions to be neutralized is high. This extraction system leads to a flange designed for pump discharge; the discharge is shown by an arrow 104 (FIG. 10).

For example, a confined plasma pump is equipped with an intake flange for pumping with an area of 90 $cm^2$, which corresponds to an area slightly greater than the area of a standard DN 100 flange.

The maximum value of the extracted electric current from the source is one of the pump parameters that characterizes its intake capacities.

A pump flow to be provided of 100 liters/second at $10^{-5}$ mbars (1 liter/second or 3.6 $m^3$ /hour at $10^{-3}$ mbars or 3.6 liter/hour at 1 mbar) corresponds to an extracted current of about 4 mA (for example in the case of monocharged $He^+$ ions).

The current to be extracted corresponds to the expected forecasts with an extraction hole diameter through the ECR source of about 2 mm and a pressure of about $10^{-3}$ mbars. If this pressure is higher, the electrical flow from the source, and therefore the pump intake capacity, will increase within the operating limits of the source and the conductance of the system.

The source (HF power, HF frequency, diameter of the extraction hole, conductance of the connection flanges, source volume, discharge pressure, etc.) will be adapted for limiting pressures or different flows.

A pump according to the invention has the following advantages:

operation within a wide pressure range, no moving mechanical parts, no joints in the pump internal mechanical structure, no regeneration, unlimited life, almost zero maintenance, no lubricating agents, the different pumped elements can be analyzed, no essential electronics on the pump itself, the price of the HF generator can be modest, for example if its frequency is 2.45 GHz, relatively low pump cost, no risk of damage, regardless of manipulations, aeration, etc., Furthermore, the pump is unaffected by vibrations and shocks, can operate in all positions and can be installed and can operate on a mobile assembly, even if this assembly to subject to violent movements and accelerations.

What is claimed is:

1. Electronic cyclotronic resonance source with:

magnetic means of generating a magnetic field in a cavity delimited by these means, the cavity having an axial direction along an axis AA and a radial direction;

means of injecting an HF wave into the said cavity, the HF wave and the magnetic field created by the magnetic means ensuring that an electronic cyclotronic resonance condition is maintained in the cavity;

means of injecting gases into the cavity the source being characterized in that the magnetic means comprise:

first magnetic means ($M_3$) comprising a number $N_1$ of elements (62-1, 62-2, 62-3, 62-4), where $N_1$ is an integer number $\geqq 0$, the $N_1$ elements together forming an axial magnetic structure;

second magnetic means ($M_1$, $M_2$) each comprising $N_2$ elements (64-2 . . . 64-5; 66-2, . . . 66-4) where $N_2$ is an integer number $\geqq 0$ together forming a radial magnetic structure, these elements (64-2 . . . 64-5; 66-2 . . . 66-4), being in the form of rings (64-2 . . . 64-5; 66-2, . . . 66-4), the rings of each of the subsets ebing nested inside each other and the vector sum of the fields created by the first ($M_3$) and the second ($M_1$, $M_2$) magnetic means being used to define at least one closed line of minima of the modulus B of the vector sum, inside one or several volumes inside the cavity and delimited by the surfaces with constant modulus $B_f$ in the magnetic field.

2. Source according to claim 1, characterized in that the first and second means of generating magnetic fields ($M_1$, $M_2$, $M_3$, 62-1, . . . , 62-4; 64-1, . . . , 64-5; 66-1, . . . , 66-4) are permanent magnets.

3. Source according to claim 1, characterized in that the first and second means of generating magnetic fields ($M_1$, $M_2$, $M_3$, 62-1, . . . , 62-4; 64-1, . . . , 64-5; 66-1 . . . . 66-4) are coils.

4. Source according to claim 1, characterized in that the second magnetic means ($M_3$, 62-1 . . . , 62-4) together forming the axial structure (113) are in the form of rings (62-1 . . . 62-4) placed axially adjacent to each other.

5. Source according to claim 1, characterized in that the second magnetic means ($M_1$, $M_2$, 64-1, . . . , 64-5; 66-1, . . . , 66-4) together form the radial structure comprising a central opening (68, $S_1$, $S_2$, 96).

6. Source according to claim 4, characterized in that a ring (62-1, . . . , 62-4), in the first magnetic means, comprises an opening.

7. Source according to claim 4, characterized in that the means (62-1, . . . , 62-4) together forming the axial magnetic structure are separated, thus forming an opening.

8. Source according to claim 1, characterized in that the first means are composed of $N_1$ magnetic elements arranged coaxially, with some inside the others depending on their diameter, either in the same plane, or slightly offset from each other.

9. Cyclotron operating process, characterized in that ions are injected into the cyclotron from a source according to claim 1 placed inside the cyclotron.

10. Cyclotron operating process according to claim 9, characterized in that the source is placed at the center of the cyclotron.

11. Transport process for charged particles using a source according to claim 4, the particles being transported from one end to the other of the set of adjacent rings.

12. Confined plasma pump comprising a source according to claim 1, means (108) of connecting to a volume to be pumped and extraction means (96, 100, 102).

13. Cyclotron operating process, characterized in that ions are injected into the cyclotron from a source according to claim 8 placed inside the cyclotron.

* * * * *